US011772397B2

(12) United States Patent
Kondo et al.

(10) Patent No.: US 11,772,397 B2
(45) Date of Patent: Oct. 3, 2023

(54) TAPE CASSETTE

(71) Applicant: BROTHER KOGYO KABUSHIKI KAISHA, Nagoya (JP)

(72) Inventors: Tomohiro Kondo, Nagoya (JP); Mariko Niizeki, Ichinomiya (JP); Shunsuke Mizutani, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/059,403

(22) Filed: Nov. 28, 2022

(65) Prior Publication Data

US 2023/0166547 A1 Jun. 1, 2023

(30) Foreign Application Priority Data

Nov. 30, 2021 (JP) ..... 2021-194544

(51) Int. Cl.

| | |
|---|---|
| ***B41J 32/00*** | (2006.01) |
| ***B41J 3/36*** | (2006.01) |
| ***B41J 2/325*** | (2006.01) |
| ***B41J 3/407*** | (2006.01) |
| ***B41J 33/26*** | (2006.01) |

(52) U.S. Cl.

CPC ..... *B41J 32/00* (2013.01); *B41J 2/325* (2013.01); *B41J 3/36* (2013.01); *B41J 3/4075* (2013.01); *B41J 33/26* (2013.01)

(58) Field of Classification Search

CPC ... B41J 2/325; B41J 3/36; B41J 3/4075; B41J 32/00; B41J 33/26

See application file for complete search history.

(56) References Cited

U.S. PATENT DOCUMENTS

2010/0329767 A1 12/2010 Sago et al.
2012/0080550 A1* 4/2012 Yamaguchi ..... B41J 32/00 242/160.4

FOREIGN PATENT DOCUMENTS

JP 2011-11399 A 1/2011

* cited by examiner

*Primary Examiner* — Christopher E Mahoney
*Assistant Examiner* — Marissa Ferguson-Samreth
(74) *Attorney, Agent, or Firm* — Kenealy Vaidya LLP

(57) ABSTRACT

A tape cassette includes a recess formed on a part of a side wall of a cassette case, an arm portion, a roller partly exposed from the tape cassette, a first protrusion including a first leading end, and a second protrusion including a second leading end. The first leading end and the second leading end protrudes toward first side. The first leading end is positioned on a first virtual line or further to the first side than the first virtual line. The first virtual line connects an exposed part of an outer peripheral surface of the roller with a connection portion between the recess and a wall comprising the arm portion. The second leading end is positioned further to the first side than a second virtual line. The second virtual line connects the exposed part of the outer peripheral surface of the roller with the first leading end.

9 Claims, 10 Drawing Sheets

TAPE CASSETTE

REFERENCE TO RELATED APPLICATIONS

This application claims priority to Japanese Patent Application No. 2021-194544, filed on Nov. 30, 2021, the content of which is hereby incorporated by reference.

BACKGROUND ART

The present disclosure relates to a tape cassette housing a print material.

In known art, a tape cassette is known that clamps a film tape and an ink ribbon between a platen roller and a thermal head, and prints characters and the like on the film tape, by heat transfer printing. The film tape is conveyed toward a tape discharge port as a result of a tape feed roller and a movable conveyance roller working in concert. Between the platen roller and the movable conveyance roller, a guide wall is provided that guides the ink ribbon to a ribbon winding spool. The guide wall separates the ink ribbon from the film tape as a result of an end of the guide wall pressing against the ink ribbon.

DESCRIPTION

As a result of the ribbon winding spool being driven to rotate and pulling and winding the ink ribbon, the ink ribbon comes into contact with the end of the guide wall and is pulled away from the film tape. However, if a frictional force generated by the film tape pressing the ink ribbon against the end of the guide wall is greater than a force with which the ribbon winding spool pulls the ink ribbon, there is a possibility that the film tape may be conveyed without the ink ribbon being sufficiently separated from the film tape, and a jam may occur in the region of the end of the guide wall. If the force with which the ribbon winding spool pulls the ink ribbon is increased, the ink ribbon is removed from the film tape before the characters and the like transferred from the ink ribbon are fixed on the film tape, and there is a possibility that it is not possible to secure a peeling distance required for the fixing of the transferred characters and the like.

The object of the present disclosure is to provide a tape cassette in which the ink ribbon can be more reliably peeled while securing a peeling distance.

A tape cassette according to the present disclosure includes a cassette case, a tape roll, a print tape, a ribbon roll, an ink ribbon, a ribbon winding spool, an arm portion, a roller, a first protrusion, and a second protrusion. The cassette case includes a bottom wall and a side wall. The side wall intersects the bottom wall at a first side in a first direction. The cassette case has a recess that is recessed from a part of the side wall to a second side in the first direction. The second side in the first direction is opposite to the first side in the first direction. The part of the side wall includes an opening. The recess passes through the cassette case in an up-down direction. The tape roll is housed inside the cassette case. The print tape is wound around the tape roll. The ribbon roll is housed inside the cassette case. The ink ribbon is wound around the ribbon roll. The ribbon winding spool is housed inside the cassette case. The arm portion includes a first wall and a second wall. The first wall is a part of the side wall. The second wall faces the first wall and extends upward from the bottom wall. The arm portion extends from a first side in a second direction to a second side in the second direction. The second direction is a direction intersecting the first direction and the up-down direction. The first side in the second direction is opposite to the second side in the second direction. The arm portion includes a discharge port at an end. The end is positioned on the second side in the second direction with respect to the opening. The discharge port is configured to discharge the print tape and the ink ribbon conveyed between the first wall and the second wall. The recess is defined by the second wall and a peripheral wall at least. The roller is provided inside the cassette case further to the first side in the second direction than the arm portion. A part of an outer peripheral surface of the roller is exposed to the first side in the first direction of the cassette case. The roller is configured to guide the print tape. The print tape is discharged from the discharge port and is in contact with the exposed part of the outer peripheral surface further to the first side in the second direction than the cassette case. The first protrusion is disposed, on a conveyance path of the print tape, at a position between the discharge port of the arm portion and the roller. The first protrusion includes a first leading end protruding toward the first side in the first direction. The first leading end is positioned on a first virtual line or being positioned further to the first side in the first direction than the first virtual line. The first virtual line is a line connecting the exposed part of the outer peripheral surface of the roller with a connection portion between the second wall and the peripheral wall. The first protrusion is configured to guide the ink ribbon discharged along the conveyance path from the discharge port to a winding path. The winding path is a path branching from the conveyance path at the first leading end, toward the ribbon winding spool. The second protrusion is disposed at a position between the first protrusion and the roller in the second direction. The second protrusion includes a second leading end protruding toward the first side in the first direction. The second leading end is positioned further to the first side in the first direction than a second virtual line. The second virtual line is a line connecting the exposed part of the outer peripheral surface of the roller with the first leading end of the first protrusion. The second protrusion is configured to guide the print tape discharged from the discharge port to the roller via the second leading end.

By adopting a configuration in which, at a time of printing, the first leading end of the first protrusion is positioned on the first virtual line along which the print tape and the ink ribbon can be conveyed, or further to the one side, in the first direction, than the virtual line, and the first protrusion presses the print tape and the ink ribbon to the first side in the first direction, the tape cassette reliably peels the ink ribbon from the print tape using the first leading end. In addition, by adopting a configuration in which the second leading end of the second protrusion is disposed further to the one side in the first direction than the second virtual line, at a position downstream of the position of the first leading end, and the second protrusion presses the print tape to the one side in the first direction, the print tape separates slightly from the ink ribbon, and the tape cassette weakens a force with which the print tape presses the ink ribbon against the first leading end. In this way, the tape cassette can reduce a frictional force generated between the ink ribbon and the first leading end as a result of the print tape pressing the ink ribbon against the first leading end. Thus, after characters or the like are transferred from the ink ribbon to the print tape, the print tape and the ink ribbon can reach the first leading end without being forcibly peeled apart. As a result, the tape cassette can more reliably perform the peeling of the ink ribbon while securing a peeling distance.

Hereinafter, an embodiment embodying the present disclosure will be described with reference to the drawings. The referenced drawings are used to illustrate technological features that can be adopted by the present disclosure, and configurations, control, and the like of devices described herein are not intended to limit the present disclosure to those configurations, control, and the like, and are simply explanatory examples.

Figure 1:
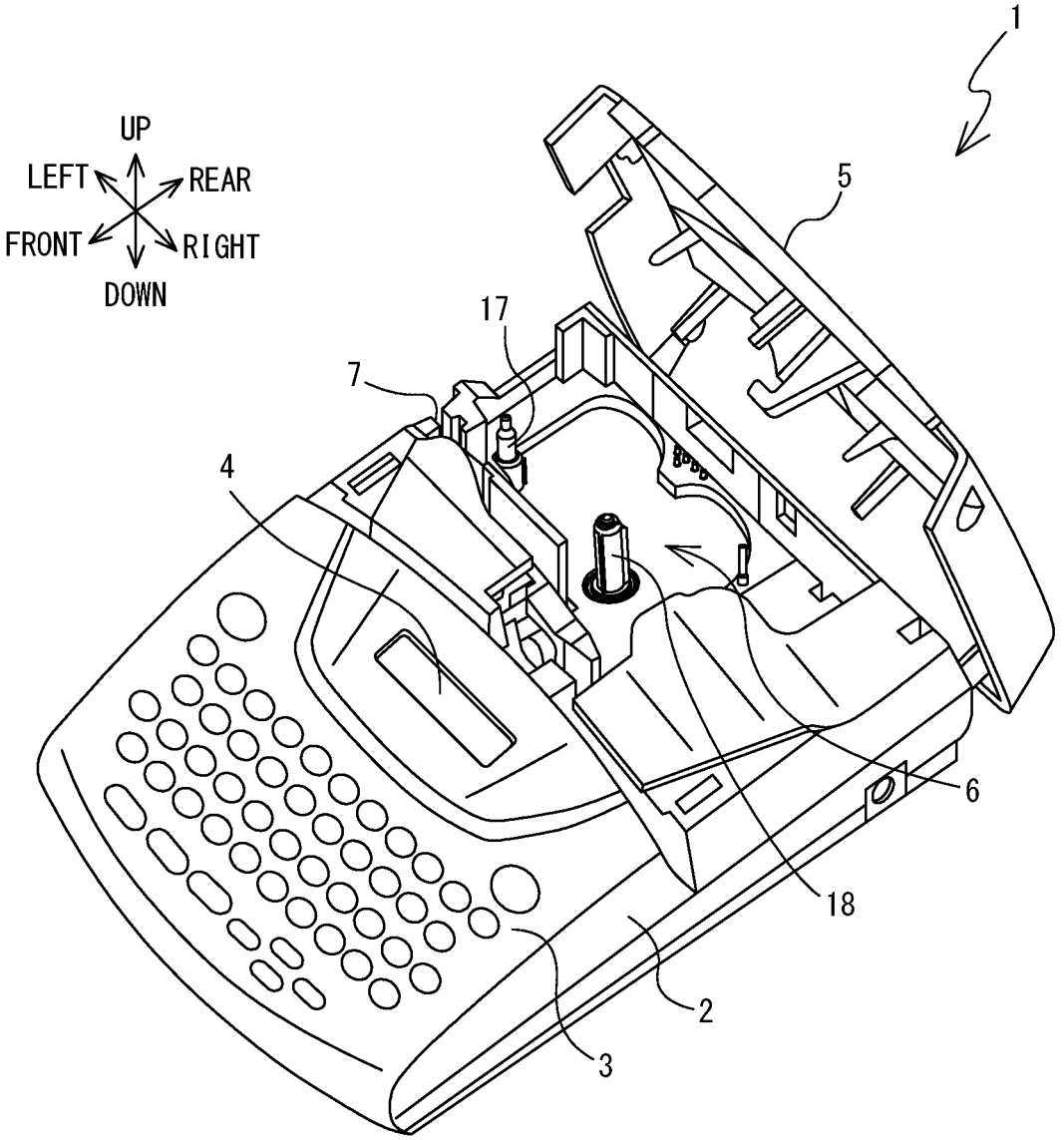
FIG. 1 is a perspective view of a tape printer with a cassette cover open.

Hereinafter, the lower left direction, the upper right direction, the lower right direction, the upper left direction, the upper direction, and the lower direction in FIG. 1 are, respectively, the front direction, the rear direction, the right direction, the left direction, the upper direction, and the lower direction of a tape printer 1. The lower right direction, the upper left direction, the upper right direction, the lower left direction, the upper direction, and the lower direction in FIG. 2 are, respectively, the front direction, the rear direction, the right direction, the left direction, the upper direction, and the lower direction of a tape cassette 30.

The tape cassette 30 of the present embodiment can be mounted in the tape printer 1. The tape printer 1 is a general-purpose printer that can use various tape cassettes, such as a thermal type, a laminate type, a receptor type, and the like. The thermal type tape cassette is provided with a heat-sensitive paper tape. The laminate type tape cassette is provided with a double-sided adhesive tape, a film tape, and an ink ribbon. The tape cassette 30 is the receptor type tape cassette, and is provided with a print tape 8 and an ink ribbon 9. The tape printer 1 performs printing by transferring ink of the ink ribbon 9 to the print tape 8, by applying heat.

As shown in FIG. 1, the tape printer 1 is provided with a cuboid-shaped main body cover 2. An input portion 3 is provided at a front portion of the upper surface of the main body cover 2. The tape printer 1 receives operations via the input portion 3, such as the input of various information, switching on and off of a power source, and the like. A display 4 is provided to the rear of the input portion 3. The display 4 can display the various input information, and the like. A cassette cover 5 is attached to the main body cover 2, further to the rear than the display 4. The cassette cover 5 covers a mount portion 6 from above in an openable/closable manner, the tape cassette 30 being detachably mounted to the mount portion 6. A user opens and closes the cassette cover 5 when replacing the tape cassette 30. A discharge port 7 is provided at the left of the main body cover 2. The printed print tape 8 is discharged from the tape printer 1 via the discharge port 7.

Figure 2:
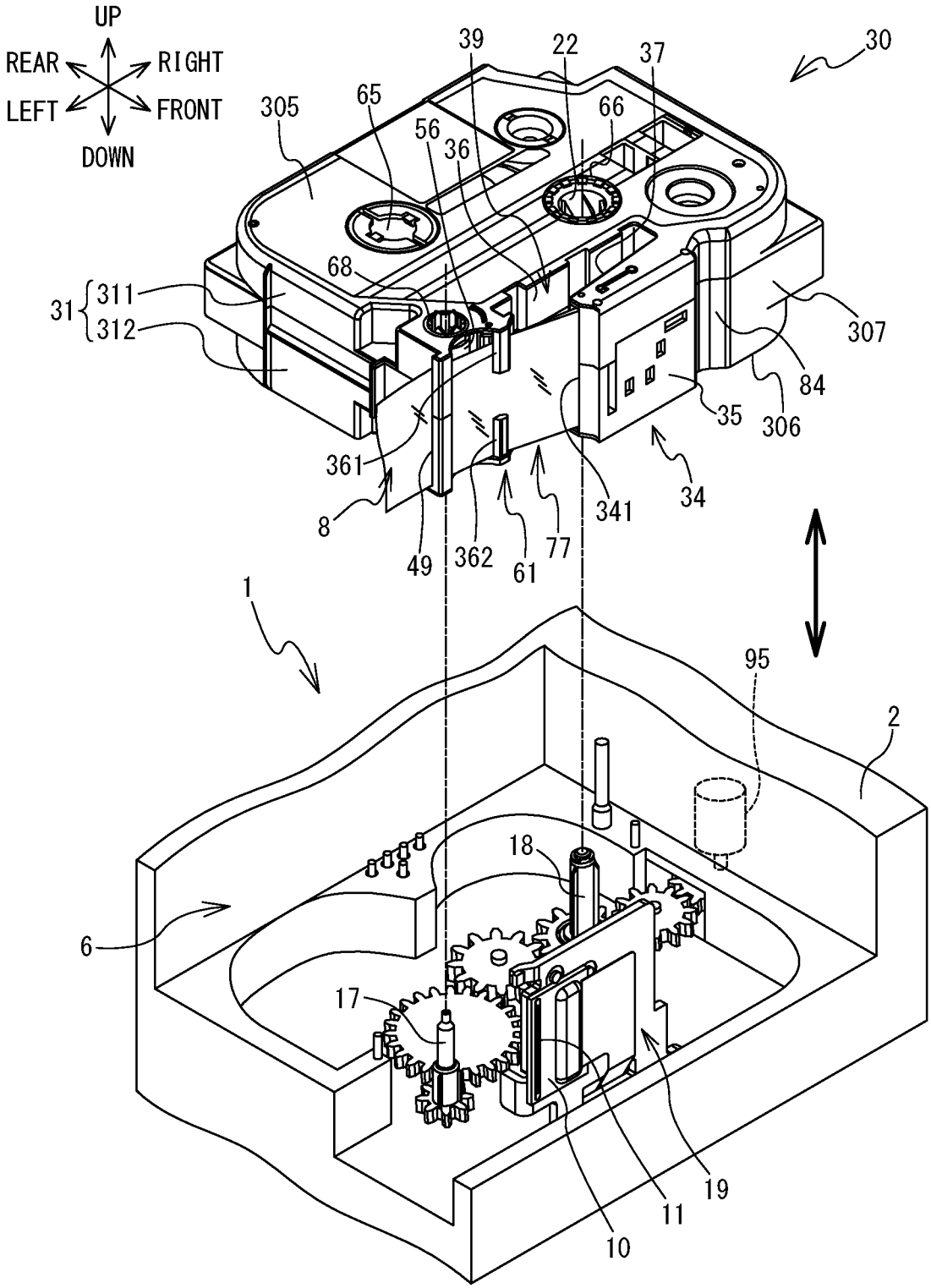
FIG. 2 is a perspective view of a tape cassette and a mount portion.
Figure 3:
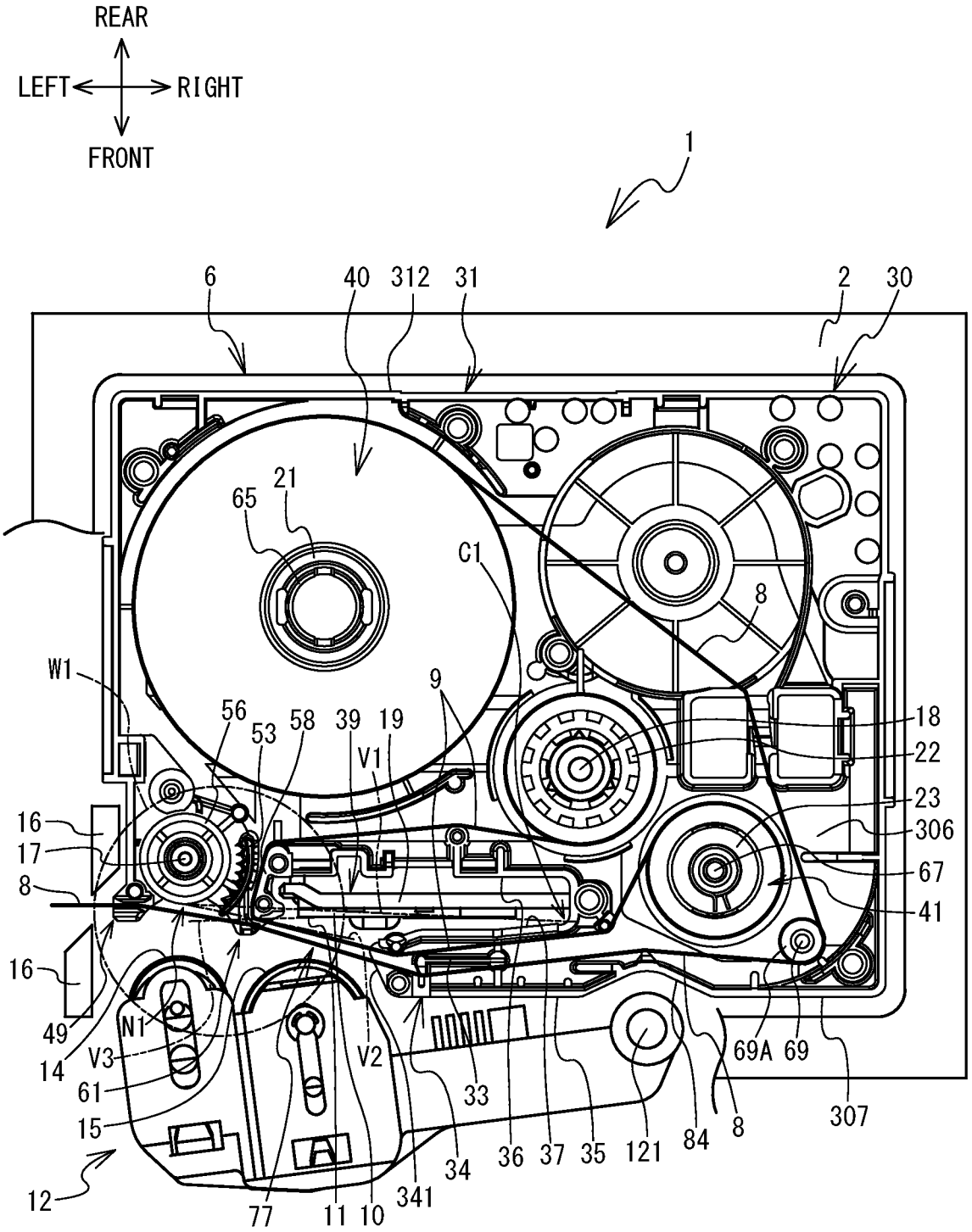
FIG. 3 is a plan view of the mount portion when the tape cassette is mounted and a platen holder is at a stand-by position.

As shown in FIG. 2 and FIG. 3, the mount portion 6 has a shape corresponding to the tape cassette 30, and is recessed downward from the upper surface of the main body cover 2. The tape cassette 30 is detachably mounted to the mount portion 6. A head holder 19 is provided at a front portion of the mount portion 6. The head holder 19 is plate-shaped, and extends in the up-down direction and the left-right direction. When the tape cassette 30 is mounted to the mount portion 6, the head holder 19 is inserted into a head insertion portion 39 of the tape cassette 30. A thermal head 10 is provided at the front surface of the head holder 19. The thermal head 10 is provided with a plurality of heating elements 11. The plurality of heating elements 11 are aligned in a single row in the up-down direction. In a state in which the tape cassette 30 is mounted to the mount portion 6, the thermal head 10 heats, using the plurality of heating elements 11, the ink ribbon 9 exposed from an arm opening 341 to be described later.

A conveyance motor 95 is installed outside the mount portion 6 (to the upper right of the mount portion 6 in FIG. 2). The conveyance motor 95 is a stepping motor. The conveyance motor 95 rotationally drives a tape drive shaft 17 and a ribbon winding shaft 18, via a plurality of coupling gears. The tape drive shaft 17 is rotatably installed standing upward at a position at a front left portion of the mount portion 6. The tape drive shaft 17 is a shaft body that can be detachably mounted to a feed roller 56 to be described later. The print tape 8 is conveyed as a result of the tape drive shaft 17 rotating. The ribbon winding shaft 18 is rotatably installed standing upward at a position at substantially the center of the mount portion 6. The ribbon winding shaft 18 is a shaft body that can be detachably mounted to a ribbon winding spool 22 to be described later.

As shown in FIG. 3, a cutting mechanism 16 is provided to the left of the tape drive shaft 17. The cutting mechanism 16 cuts the print tape 8 as a result of being driven by a cutting motor (not shown in the drawings). A platen holder 12 is provided to the front of the head holder 19. The platen holder 12 is arm-shaped, and is supported by a support shaft 121 so as to be able to pivot around a vertical axis. The support shaft 121 is provided at the right end of the platen holder 12.

A platen roller 15 and a conveyance roller 14 are both rotatably supported at the leading end of the platen holder 12. The platen roller 15 can approach or separate from the thermal head 10 in accordance with the pivoting of the platen holder 12. The conveyance roller 14 is provided to the left of the platen roller 15, and can approach or separate from the feed roller 56 in accordance with the pivoting of the platen holder 12.

Figure 6:
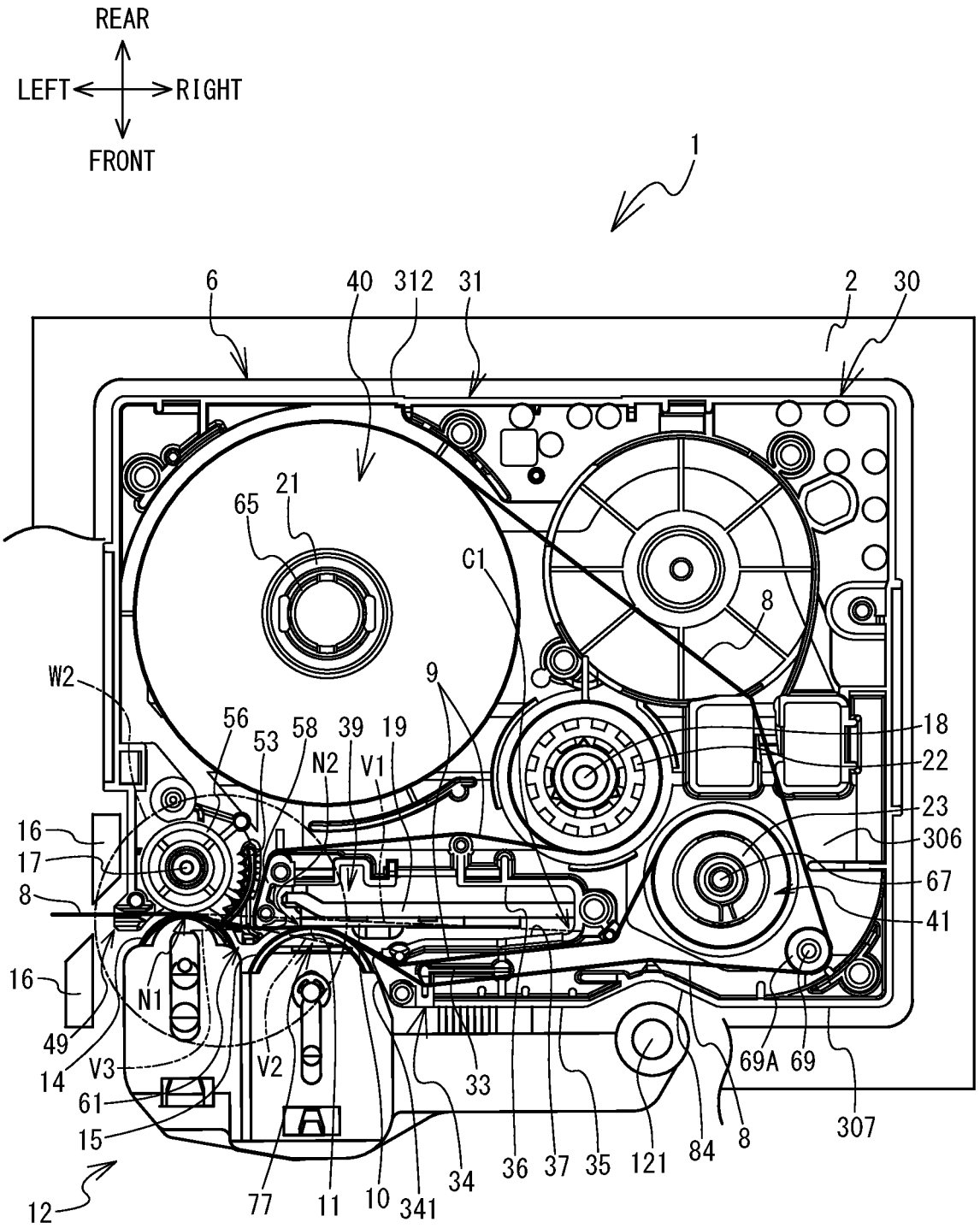
FIG. 6 is a plan view of the mount portion when the tape cassette is mounted and the platen holder is at a print position.

In the present embodiment, when the cassette cover 5 is opened, the platen holder 12 is configured to move toward a stand-by position (a position shown in FIG. 3), and when the cassette cover 5 is closed, the platen holder 12 is configured to move toward a print position (a position shown in FIG. 6). In the stand-by position, the platen holder 12 moves in a direction separating from the mount portion 6. Thus, the user can attach or remove the tape cassette 30 to and from the mount portion 6. In the print position, the platen holder 12 moves in a direction approaching the mount portion 6. Thus, when the tape cassette 30 is mounted to the mount portion 6, the platen roller 15 presses the print tape 8 and the ink ribbon 9 against the thermal head 10, and the conveyance roller 14 presses the print tape 8 against the feed roller 56.

The platen roller 15 is driven to rotate in concert with the tape drive shaft 17, by the conveyance motor 95. In order to suppress warping of the print tape 8 by the conveyance, the platen roller 15 is coupled to the conveyance motor 95 via a plurality of gears (not shown in the drawings), so that a rotation speed of the platen roller 15 is slower than a rotation speed of the tape drive shaft 17 (the feed roller 56).

Figure 4:
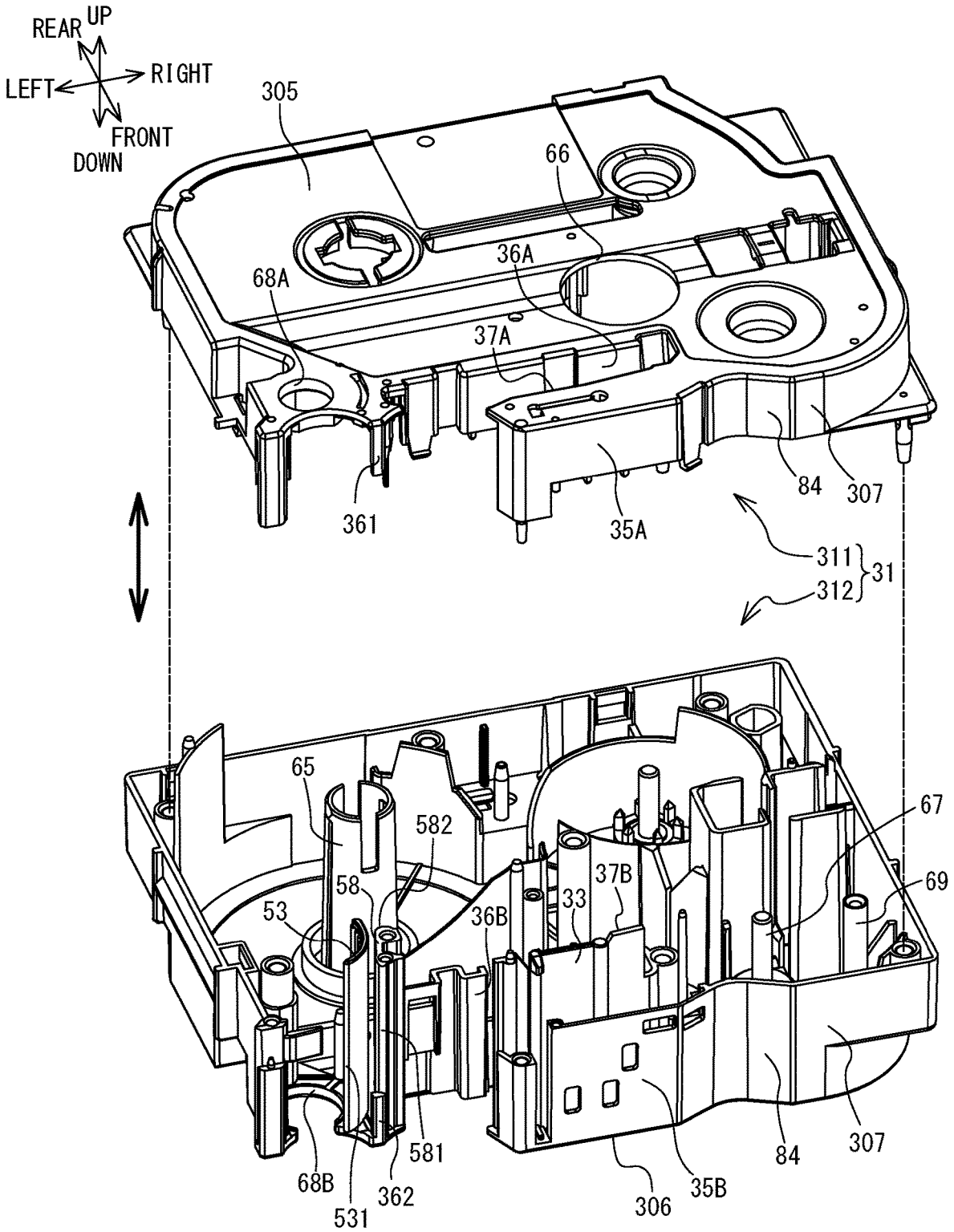
FIG. 4 is a perspective view of an upper case and a lower case of a cassette case.

As shown in FIG. 2 to FIG. 4, the tape cassette 30 includes a cassette case 31. The cassette case 31 is substantially cuboid, and is configured by combining an upper case 311 and a lower case 312. The upper case 311 includes an upper wall 305 forming the upper surface of the cassette case 31, and is a box shape that is open downward. The lower case 312 includes a bottom wall 306 forming the bottom surface of the cassette case 31, and is a box shape that is open upward. The upper case 311 is fixed to an upper portion of the lower case 312.

A support cylinder 65, which rotatably supports a tape spool 21 mounted inside the cassette case 31, is provided at a rear left portion of the cassette case 31. The support cylinder 65 protrudes in a cylindrical shape upward from the bottom wall 306 of the lower case 312. The print tape 8 is wound around the tape spool 21. A supply source of the print tape 8 configured by the print tape 8 being wound around the tape spool 21 is referred to as a tape roll 40.

A ribbon boss 67, which rotatably supports a ribbon spool 23 mounted inside the cassette case 31, is provided at a front right portion of the cassette case 31. The ribbon boss 67 protrudes upward from the bottom wall 306 of the lower case 312. The ink ribbon 9 is wound around the ribbon spool 23. A supply source of the ink ribbon 9 configured by the ink ribbon 9 being wound around the ribbon spool 23 is referred to as a ribbon roll 41.

A support hole 66, which rotatably supports the ribbon winding spool 22 mounted inside the cassette case 31, is provided substantially at a center portion of the cassette case 31, between the ribbon boss 67 and the support cylinder 65. The support hole 66 is a through hole passing through the cassette case 31 in the up-down direction. The ribbon winding shaft 18 is inserted into the ribbon winding spool 22. The ribbon winding spool 22 rotates in accordance with the rotational driving of the ribbon winding shaft 18, and pulls out and winds the ink ribbon 9 from the ribbon roll 41.

A support hole 68, which rotatably supports the feed roller 56 is provided at a front left corner portion of the cassette case 31. The support hole 68 includes an opening 68A provided in the upper wall 305, and an opening 68B provided in the bottom wall 306. The openings 68A and 68B are through holes provided at positions corresponding to each other in the up-down direction of the cassette case 31. The feed roller 56 is cylindrically shaped, and extends in the up-down direction. The support hole 68 supports the upper end portion and the lower end portion of the feed roller 56. A portion of the front end of the outer peripheral surface of the feed roller 56 is exposed to the front from the cassette case 31. In a state in which the tape cassette 30 is mounted to the mount portion 6, the tape drive shaft 17 is inserted into the inside of the feed roller 56. The feed roller 56 rotates in accordance with the rotational driving of the tape drive shaft 17, and discharges the print tape 8 from the cassette case 31 in concert with the conveyance roller 14.

A roller shaft 69, which rotatably supports a pathway roller 69A that is a circular cylindrically-shaped rotational body, is provided at a front right corner portion of the cassette case 31. The roller shaft 69 protrudes upward from the bottom wall 306 of the lower case 312. Inside the cassette case 31, a path along which the print tape 8 is pulled out from the tape roll 40 and is discharged to the outside of the cassette case 31 via a discharge guide 49 to be described later will be referred to as a conveyance path. The pathway roller 69A defines the conveyance path of the print tape 8, and comes into contact with the print tape 8 from the left.

A semicircular recess 84, which is recessed to the rear in a substantially semicircular shape in a plan view, is provided in a front wall 307 of the cassette case 31. The semicircular recess 84 is formed across the cassette case 31 in the up-down direction. When the tape cassette 30 is mounted to the mount portion 6, the semicircular recess 84 is an escape portion that avoids interference between the tape cassette 30 and the support shaft 121 of the platen holder 12.

An arm portion 34 is provided at the front surface of the cassette case 31. The arm portion 34 extends to the left and to the front from the right front portion of the cassette case 31. Of the front wall 307 of the cassette case 31, a portion extending to the left from the semicircular recess 84 is an arm front wall 35. The arm front wall 35 is configured by combining an upper arm front wall 35A provided at the upper case 311 and a lower arm front wall 35B provided at the lower case 312.

An arm rear wall 37 that is the rear wall of the arm portion 34 is configured by combining an upper arm rear wall 37A provided at the upper case 311, and a lower arm rear wall 37B provided at the lower case 312. An arm opening 341 is provided between the left end portion of the arm front wall 35 and the left end portion of the arm rear wall 37. The arm opening 341 is formed in a slit shape that extends in the up-down direction.

A regulating wall 33, which is a wall portion extending upward from the bottom wall 306, is provided between the lower arm front wall 35B and the lower arm rear wall 37B of the lower case 312. Inside the cassette case 31, a path along which the ink ribbon 9 passes from being pulled out from the ribbon roll 41 until being wound by the ribbon winding spool 22 will be referred to as a winding path. The conveyance path of the print tape 8 and the winding path of the ink ribbon 9 both pass through the inside of the arm portion 34, and extend toward the arm opening 341. Inside the arm portion 34, the conveyance path of the print tape 8 is defined between the regulating wall 33 and the arm front wall 35, and the winding path of the ink ribbon 9 is defined between the regulating wall 33 and the arm rear wall 37.

A peripheral wall that extends to the rear from the right end portion of the arm rear wall 37 and also extends in parallel to the arm rear wall 37 is a head peripheral wall 36. The head peripheral wall 36 is configured by combining an upper head peripheral wall 36A provided at the upper case 311 and a lower head peripheral wall 36B provided at the lower case 312.

The head insertion portion 39 is a space having a substantially rectangular shape in a plan view that is defined by the arm rear wall 37 and the head peripheral wall 36. The head insertion portion 39 is a recessed shape that is recessed to the rear with respect to the arm rear wall 37. The head insertion portion 39 forms an open section that passes through the tape cassette 30 in the up-down direction. The front wall 307 of the cassette case 31 includes an opening 77 to the left of the arm opening 341 of the arm portion 34. The head insertion portion 39 is also connected to the outside at the front surface side of the tape cassette 30, via the opening 77. The head holder 19 is inserted into the head insertion portion 39 in the state in which the tape cassette 30 is mounted to the mount portion 6.

Figure 5:
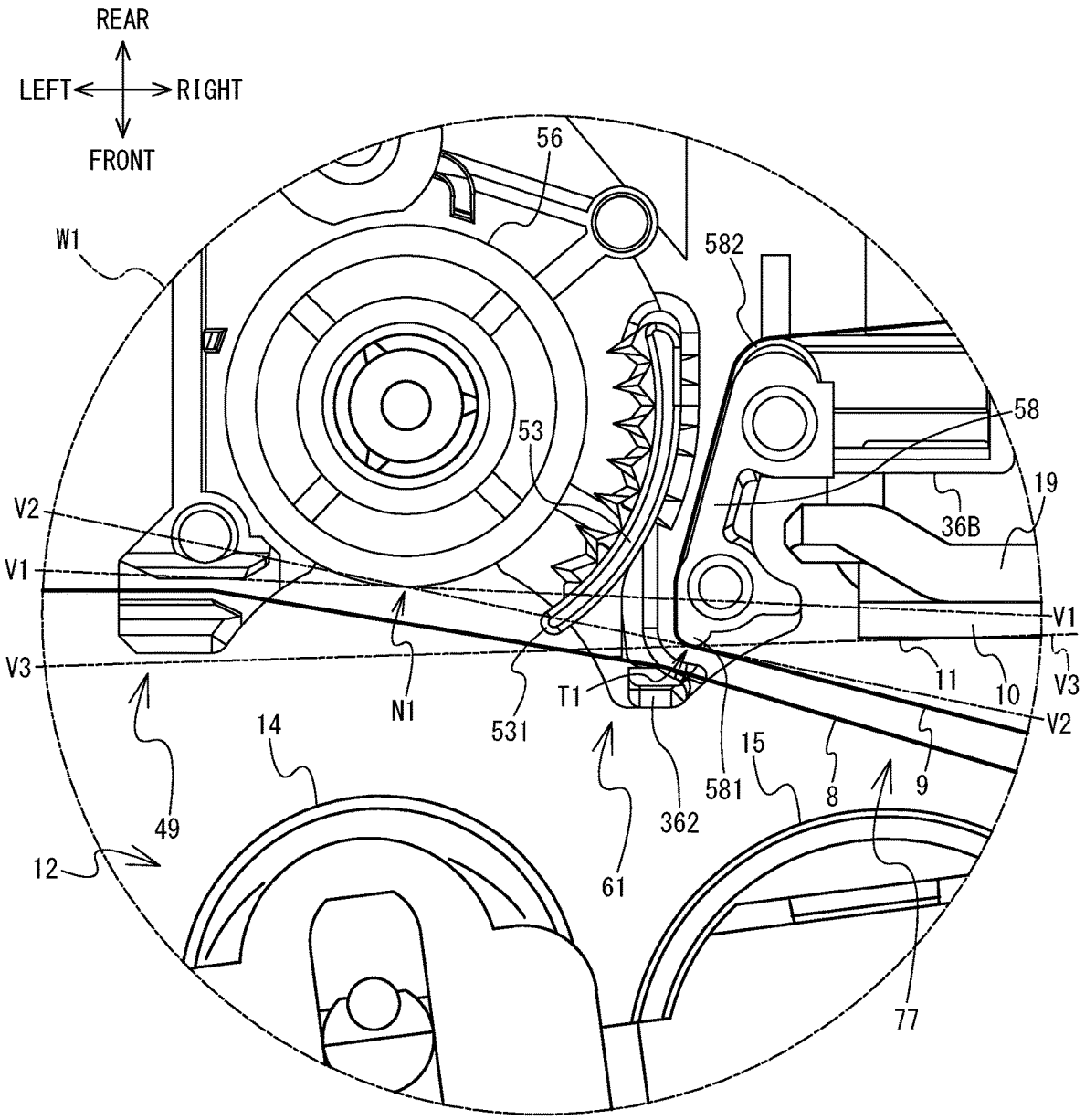
FIG. 5 is an enlarged view of a circle shown by a single dot chain line in FIG. 3.

A regulating guide 61 is provided to the left of the head insertion portion 39. The regulating guide 61 is positioned between the arm opening 341 and the feed roller 56, in the left-right direction. As shown in FIG. 4 and FIG. 5, the regulating guide 61 includes regulating members 361 and 362, a guide wall 58, and an isolation wall 53. The regulating member 361 is a plate-shaped body that extends downward from the upper wall 305. The regulating member 362 is a plate-shaped body that extends upward from the bottom wall 306 toward the regulating member 361. The regulating members 361 and 362 face each other in the up-down direction, and are positioned to the front of the guide wall 58. The regulating members 361 and 362 are positioned on the conveyance path of the print tape 8, and guide the print tape 8 to the discharge guide 49 of the cassette case 31, while regulating the forward movement of the print tape 8 discharged from the arm opening 341 of the arm portion 34.

Of the lower head peripheral wall 36B, the guide wall 58 is a wall portion that extends in the front-rear direction to the left of the head insertion portion 39. The guide wall 58 is formed in a rib shape protruding upward from the bottom wall 306 of the lower case 312. A leading end 581 at the front end of the guide wall 58 has a cross-section, in the horizontal direction, that is a semi-circular shape, and protrudes to the front in a plan view. The leading end 581 defines the winding path of the ink ribbon 9 discharged from the arm opening 341 such that the winding path is a path toward the rear along the guide wall 58. Further, at a time of printing, the leading end 581 separates the ink ribbon 9 from the print tape 8. The winding path is defined by a leading end 582 at the rear of the guide wall 58, such that the winding path is a path from the rear toward the right. The ink ribbon 9 that has passed the leading end 582 is wound by the ribbon winding spool 22 after passing along the winding path to the rear of the head peripheral wall 36.

Here, when the platen holder 12 is positioned at the print position, a gap between the feed roller 56 and the conveyance roller 14 is a nip portion N1. Further, a connection section between the arm rear wall 37 of the arm portion 34 and the head peripheral wall 36 of the head insertion portion 39 is a connection portion C1 (refer to FIG. 3). In a plan view, a virtual line connecting the nip portion N1 with the connection portion C1 is a virtual line V1. In this case, the leading end 581 of the guide wall 58 is positioned further to the front than the virtual line V1. Note that it is sufficient that the leading end 581 be configured such that, of a portion coming into contact with the ink ribbon 9, a portion furthest to the front is positioned further to the front than the virtual line V1.

The isolation wall 53 is installed standing to the left of the guide wall 58. The isolation wall 53 is provided between the guide wall 58 and the feed roller 56 in the left-right direction, and is formed in a rib shape protruding upward from the bottom wall 306 of the lower case 312. The isolation wall 53 has a shape, in a plan view, that draws a gentle arc in the front-rear direction of the cassette case 31, along a part of an outer peripheral surface of the feed roller 56. Teeth are formed in a serrated shape, in a plan view, on the left surface of the isolation wall 53.

A leading end 531 at the front end of the isolation wall 53 has a cross-section, in the horizontal direction, that is a semi-circular shape, and protrudes forward and to the left in a plan view. When the platen holder 12 is at the print position, the leading end 531 is positioned at a position to come into contact with the print tape 8 that passes the regulating guide 61 and is conveyed to the discharge guide 49, and defines the conveyance path of the print tape 8. Here, a portion of the leading end 581 of the guide wall 58 positioned furthest to the front, of a portion that comes into contact with the ink ribbon 9, is a contact portion T1. In a plan view, a virtual line connecting the nip portion N1 with the contact portion T1 is a virtual line V2. In this case, the leading end 531 of the isolation wall 53 is positioned further to the front than the virtual line V2. Note that when the platen holder 12 is at the print position, it is sufficient that a contact portion T2 (refer to FIG. 7), which is a portion positioned furthest to the front of a portion of the leading end 531 that comes into contact with the print tape 8, be positioned further to the front than the virtual line V2.

Further, in a plan view, a virtual line connecting the connection portion C1 with the contact portion T1 is a virtual line V3. In this case, the leading end 581 of the guide wall 58 is positioned further to the rear than the virtual line V3. Note that it is sufficient that the contact portion T2 of the leading end 531 be positioned further to the rear than the virtual line V3 (refer to FIG. 7).

The discharge guide 49 is provided at the front left corner portion of the cassette case 31. The discharge guide 49 is positioned to the front and left of the feed roller 56, and is formed in a slit shape extending in the up-down direction. When the printed print tape 8 that has been separated from the ink ribbon 9 is conveyed via the feed roller 56, the print tape 8 passes through the inside of the discharge guide 49. The discharge guide 49 guides the print tape 8 to the outside of the cassette case 31.

Figure 7:
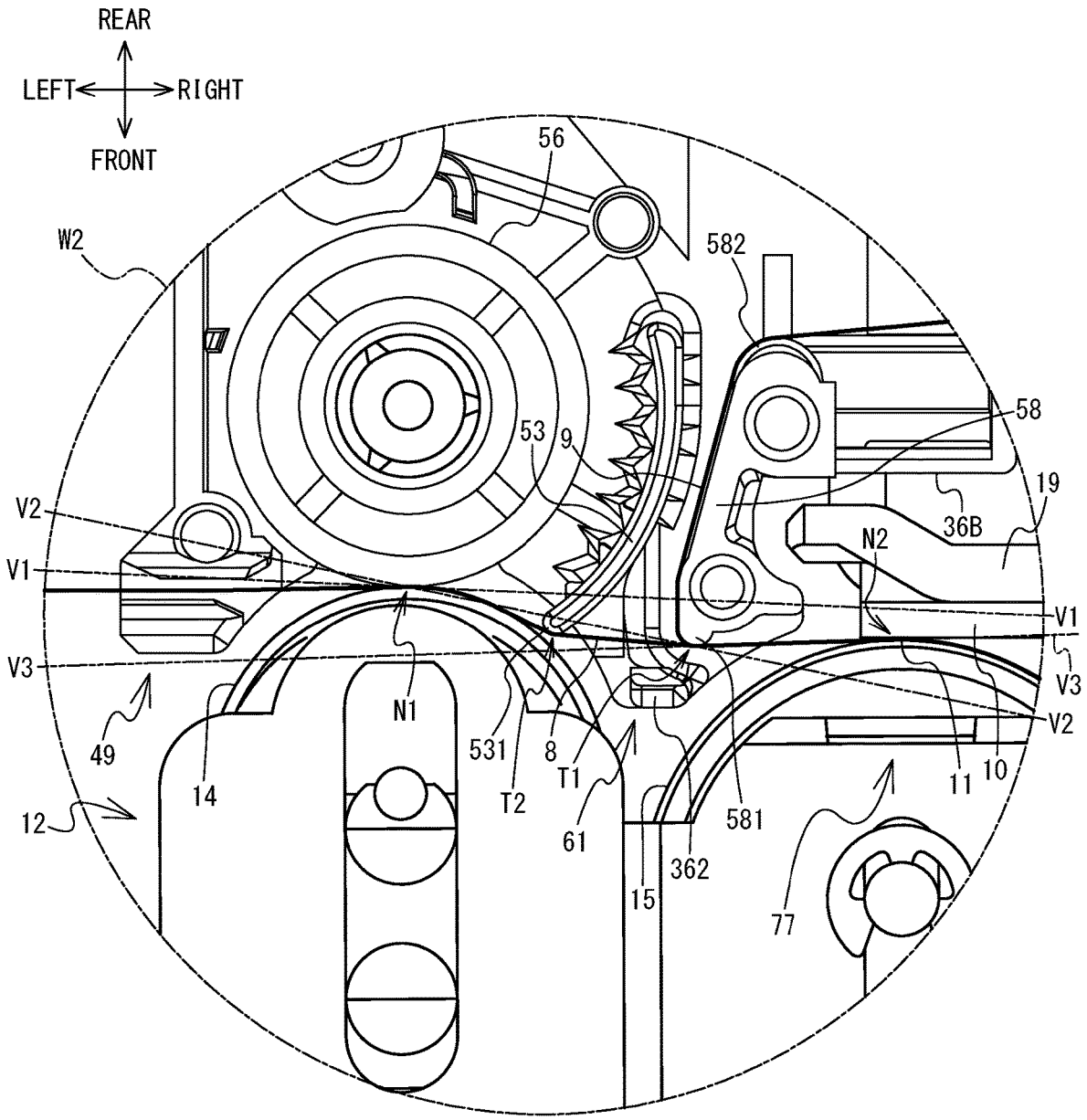
FIG. 7 is an enlarged view of a circle shown by a single dot chain linen in FIG. 6.

Conveyance and print operations of the print tape 8 will be described. As shown in FIG. 6 and FIG. 7, when the tape cassette 30 is mounted to the mount portion 6 and the cassette cover 5 is closed, the platen holder 12 moves from the stand-by position to the print position. At the nip portion N1, the print tape 8 is clamped between the conveyance roller 14 and the feed roller 56, and is pressed. The platen roller 15 enters into the opening 77, presses the print tape 8 and the ink ribbon 9 to the rear of the thermal head 10, and the print tape 8 and the ink ribbon 9 are clamped between the platen roller 15 and the heating elements 11 at a nip portion N2, and are pressed. The feed roller 56 rotates in accordance with the driving of the tape drive shaft 17, and, in concert with the conveyance roller 14, pulls out the print tape 8 from the tape roll 40. The print tape 8 is conveyed to the arm portion 34 via the pathway roller 69A. On the other hand, the ribbon winding spool 22 rotates in accordance with the driving of the ribbon winding shaft 18, and pulls out the ink ribbon 9 from the ribbon roll 41. The ink ribbon 9 is conveyed toward the arm portion 34.

Inside the arm portion 34, the print tape 8 is guided along the conveyance path passing between the arm front wall 35 and the regulating wall 33, and is discharged to the opening 77 from the arm opening 341. The ink ribbon 9 is guided along the winding path passing between the arm rear wall 37 and the regulating wall 33, is overlaid with the print tape 8, and is discharged to the opening 77 from the arm opening 341.

In the opening 77, one surface of the print tape 8 discharged from the arm opening 341 is exposed to the front, and the other surface thereof faces the thermal head 10 with the ink ribbon 9 interposed therebetween. The heating elements 11 of the thermal head 10 perform the printing by transferring the ink of the ink ribbon 9 to the print tape 8, at the nip portion N2 between the heating elements 11 and the platen roller 15.

After the printing, the ink ribbon 9 is separated from the print tape 8 by the leading end 581 of the guide wall 58. Here, the leading end 531 of the isolation wall 53 is positioned further to the rear than the virtual line V3 connecting the nip portion N2 with the contact portion T1. Thus, the print tape 8 is maintained in a state of being in contact with the ink ribbon 9 while being conveyed from the nip portion N2 to the contact portion T1. As a result, between the nip portion N2 and the contact portion T1, a peeling distance is secured for inhibiting the occurrence of peeling off of the ink due to the ink ribbon 9 being peeled from the print tape 8 before the ink transferred to the print tape 8 is fixed.

Further, the print tape 8 is pressed further to the front than the virtual line V2 connecting the contact portion T1 with the nip portion N1, by the leading end 531 of the isolation wall 53. Thus, at the contact portion T1, a force with which the print tape 8 presses the ink ribbon 9 against the leading end 531 is suppressed. As a result, the ink ribbon 9 is smoothly peeled from the print tape 8 at the leading end 531, passes along the winding path passing to the left of the guide wall 58 and to the rear of the head peripheral wall 36, and is wound by the ribbon winding spool 22.

The printed print tape 8 passes through the nip portion N1 between the feed roller 56 and the conveyance roller 14, via the leading end 531 of the isolation wall 53, and is conveyed toward the discharge guide 49. The printed print tape 8 is discharged to the outside from the discharge guide 49, is cut by the cutting mechanism 16, and is discharged to the outside of the tape printer 1.

As described above, by adopting the configuration in which, in the front-rear direction, the leading end 581 of the guide wall 58 is disposed on or further to the front than the virtual line V1 along which the print tape 8 and the ink ribbon 9 can be conveyed at the time of printing, and in which the guide wall 58 presses the print tape 8 and the ink ribbon 9 to the front in the front-rear direction, the tape cassette 30 reliably separates the ink ribbon 9 from the print tape 8 by the leading end 581. Additionally, by adopting the configuration in which the leading end 531 of the isolation wall 53 is positioned further to the front, in the front-rear direction, than the virtual line V2, at a position downstream of the position of the leading end 581, and presses the print tape 8 to the front in the front-rear direction, the print tape 8 separates slightly from the ink ribbon 9, and the force with which the print tape 8 presses the ink ribbon 9 against the leading end 581 is weakened. In this way, the tape cassette 30 can weaken the frictional force generated between the ink ribbon 9 and the leading end 581 by the print tape 8 pressing the ink ribbon 9 against the guide wall 58. Thus, after the characters and the like are transferred to the print tape 8 from the ink ribbon 9, it is possible to cause the print tape 8 and the ink ribbon 9 to reach the guide wall 58 without being forcibly peeled apart. As a result, the tape cassette 30 can reliably perform the peeling of the ink ribbon 9 while securing the peeling distance.

By causing the leading end 531, of the isolation wall 53 positioned further to the front than the virtual line V2 in the front-rear direction, to be provided further to the rear than the virtual line V3 in the front-rear direction, the tape cassette 30 regulates such that the isolation wall 53 does not strongly press the print tape 8 to the front in the front-rear direction. In this way, since the print tape 8 is not significantly separated from the ink ribbon 9 at a position upstream from the guide wall 58 on the conveyance path, the tape cassette 30 can more reliably perform the peeling of the ink ribbon 9 while securing the appropriate peeling distance.

Various modifications are possible to the present disclosure from the above-described embodiment. The leading end 581 of the guide wall 58 is positioned further to the front than the virtual line V1, but may be positioned on the virtual line V1. In this case, it is sufficient that the contact portion T1 be positioned on the virtual line V1. Further, the virtual line V1 is the virtual line connecting the nip portion N1 with the contact portion T1, but the virtual line V1 may be a virtual line connecting the nip portion N1 between the feed roller 56 and the conveyance roller 14 with the nip portion N2 between the thermal head 10 and the platen roller 15.

Figure 8:
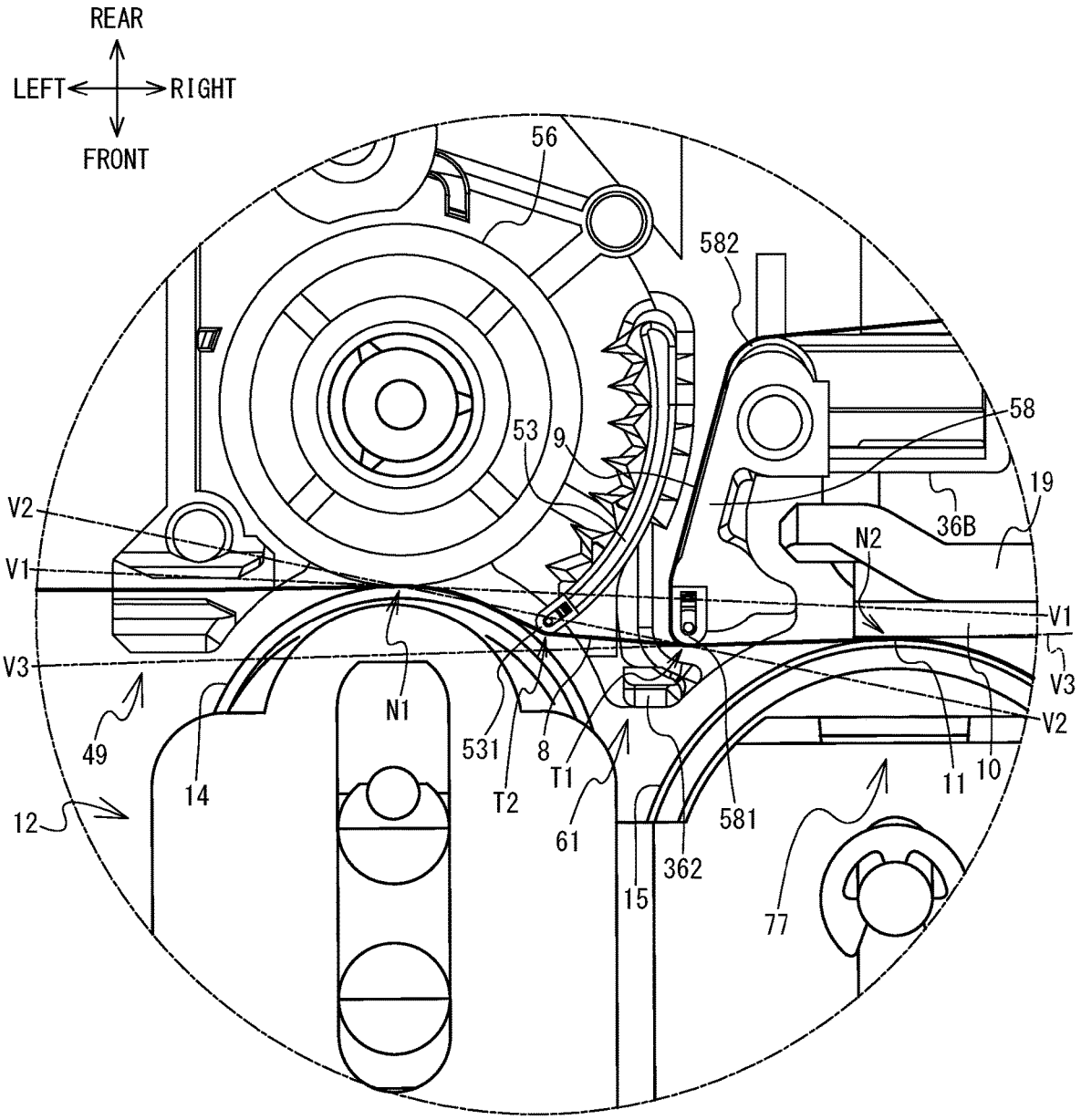
FIG. 8 is an enlarged view in the proximity of a regulating guide.
Figure 9:
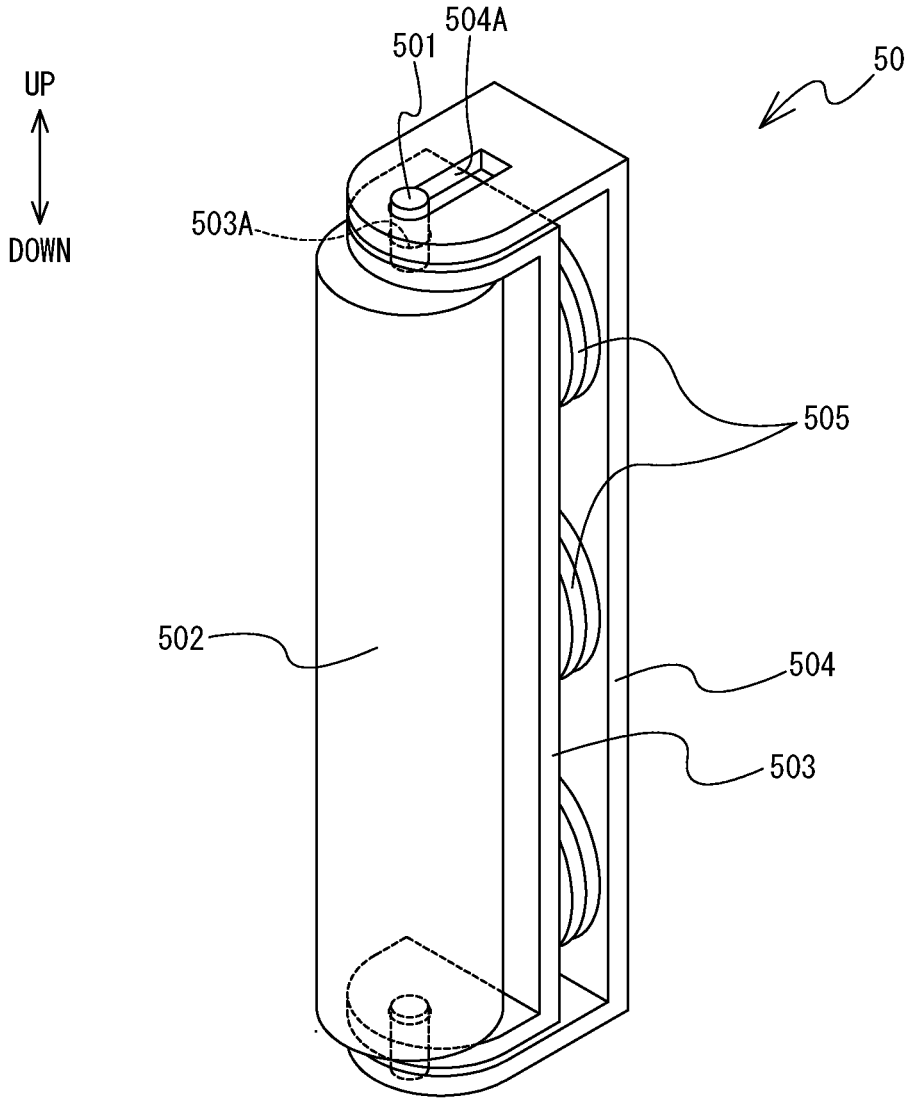
FIG. 9 is a perspective view of a roller unit.

For example, as shown in FIG. 8, a roller unit 50 may be provided at the leading end 581 of the guide wall 58 and at the leading end 531 of the isolation wall 53. As shown in FIG. 9, the roller unit 50 includes a roller member 502 having a shaft 501 extending in the up-down direction. A first support plate 503 has a plate shape extending in the up-down direction, both ends thereof are bent, and shaft holes 503A, through which the shaft 501 can be inserted, are respectively formed in the ends. The first support plate 503 rotatably supports the shaft 501 of the roller member 502, using the shaft holes 503A. A second support plate 504 has a plate shape extending in the up-down direction, and is positioned to the outside of the first support plate 503. Both ends of the second support plate 504 are bent and grooves 504A, into which the shaft 501 can be inserted, are respectively formed in the ends. Using the grooves 504A, the second support plate 504 movably holds the shaft 501 of the roller member 502, from the outside of the first support plate 503. A spring 505 is disposed between the first support plate 503 and the second support plate 504. The spring 505 urges the roller member 502 held by the first support plate 503 in a direction separating from the second support plate 504. With this type of configuration, the roller unit 50 is provided at the leading ends 581 and 531 of the guide wall 58 and the isolation wall 53, in an orientation such that the contact portions T1 and T2 are respectively positioned in the urging direction of the roller member 502 by the spring 505. In this way, when peeling the ink ribbon 9 after the printing from the print tape 8, the tape cassette 30 can alleviate a pressing force applied to the ink ribbon 9 by the print tape 8. The roller unit 50 may be provided on only one of the leading end 581 of the guide wall 58 or the leading end 531 of the isolation wall 53, or may be provided on both leading ends. Further, the roller unit 50 may omit the configuration of the second support plate 504 and the spring 505, and a configuration may be adopted in which the roller member 502 is simply provided at the leading ends 581 and 531 of the guide wall 58 and the isolation wall 53. Alternatively, the roller member 502 may be configured to be unable to rotate, and a configuration adopted in which a cylindrical member urged by the spring 505 is simply disposed at the contact portions T1 and T2.

In the modified examples described above, the isolation wall 53 and the guide wall 58 together form the winding path, and thus can guide the ink ribbon 9 to the ribbon winding spool 22. Then, the isolation wall 53 has the rib shape, and can be formed integrally with the bottom wall 306. Further, the leading end 531 is the roller member 502, and thus, the frictional force in the conveyance of the print tape 8 is reduced. As a result, the tape cassette 30 can smoothly convey the print tape 8, and can thus reliably perform the peeling of the ink ribbon 9 while securing the peeling distance.

The guide wall 58 has the rib shape, and can thus be formed integrally with the bottom wall 306. Further, the leading end 581 is the roller member 502, and the frictional force in the conveyance of the ink ribbon 9 clamped between the print tape 8 and the leading end 581 of the guide wall 58 is thus reduced. As a result, the tape cassette 30 can smoothly perform the peeling of the ink ribbon 9 from the print tape 8, while securing the peeling distance.

Further, the roller unit 50 includes the spring 505, and thus, using the urging force, the position of the print tape 8 on the conveyance path is maintained at a predetermined position. When a tension on the print tape 8 has become large, an elastic behavior can tolerate a temporary positional displacement of the print tape 8. Thus, the guide wall 58 can reduce the frictional force in the conveyance of the ink ribbon 9 clamped between the print tape 8 and the leading end 581 of the guide wall 58. In a similar manner, the isolation wall 53 can reduce the frictional force in the conveyance of the print tape 8. Thus, since the tape cassette 30 can smoothly convey the print tape 8, the tape cassette 30 can more reliably perform the peeling of the ink ribbon 9 while securing the peeling distance.

Figure 10:
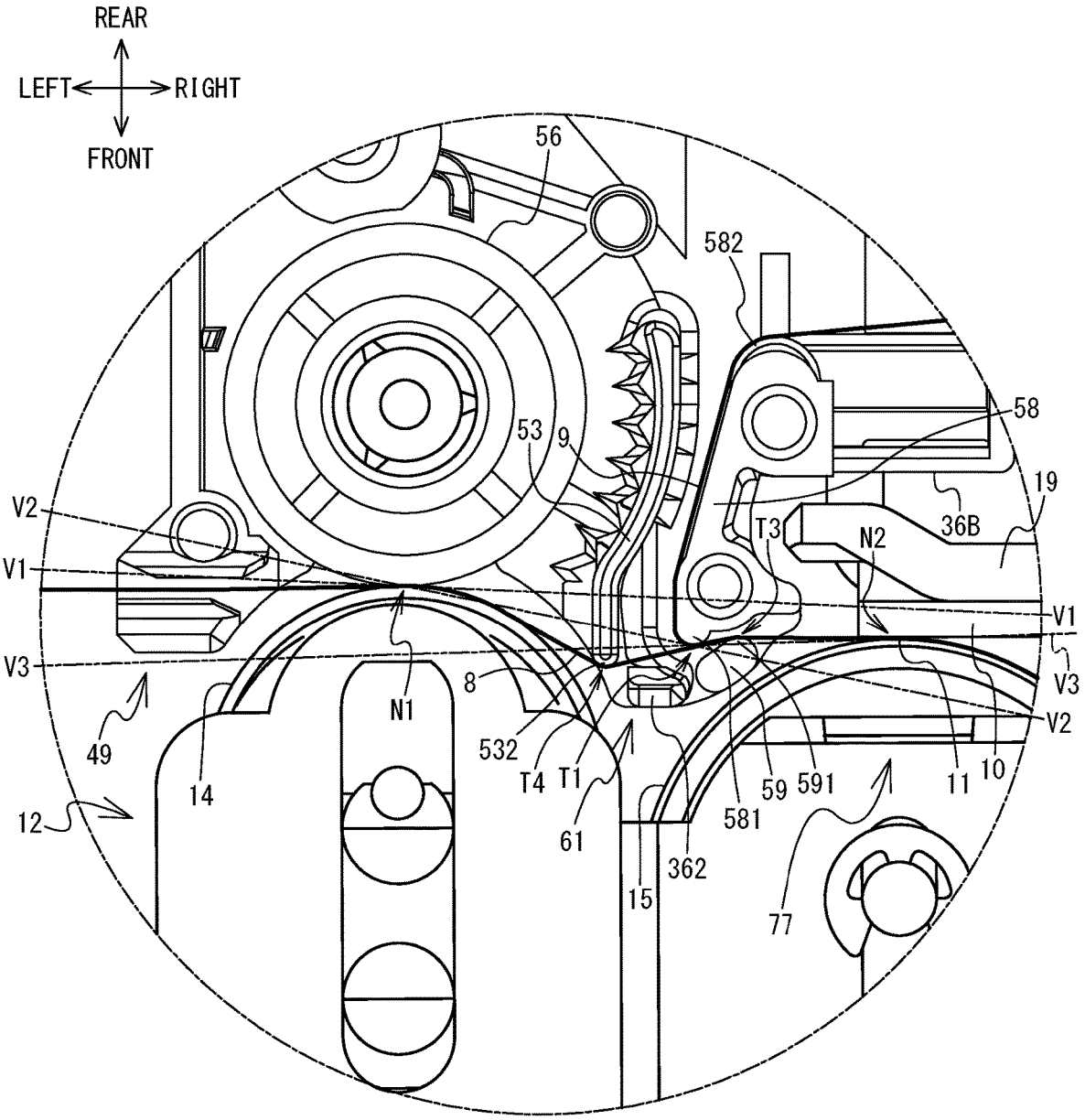
FIG. 10 is an enlarged view of the proximity of the regulating guide.

Further, as shown in FIG. 10, in the conveyance direction of the print tape 8, the regulating guide 61 may be provided with a presser wall 59, between the nip portion N2 of the thermal head 10 and the contact portion T1 of the leading end 581 of the guide wall 58. The presser wall 59 extends in the front-rear direction, and is formed in a rib shape protruding upward from the bottom wall 306 of the lower case 312. In this case, a leading end 591 at the rear of the presser wall 59 is positioned further to the rear than the virtual line V3 connecting the connection portion C1 with the contact portion T1. According to this configuration, while the print tape 8 is conveyed from the nip portion N2 to a contact portion T3 at which the leading end 591 of the presser wall 59 comes into contact with the print tape 8, a state of contact between the print tape 8 and the ink ribbon 9 is maintained, and thus, it is possible to secure the peeling distance.

Further, in this case, it is preferable that the leading end 532 of the isolation wall 53 (a contact portion T4) be positioned further to the front than the virtual line V3. According to this configuration, while the print tape 8 is conveyed from the contact portion T3 to the contact portion T4, the print tape 8 is gradually separated from the ink ribbon 9, and thus, the force with which the print tape 8 presses the ink ribbon 9 against the leading end 581 at the contact portion T1 is suppressed. Thus, at the leading end 581, the ink ribbon 9 can be smoothly peeled from the print tape 8. Further, in a similar manner as described above, the roller unit 50 may be provided at the leading end 591 of the presser wall 59, or the roller unit 50 having the configuration in which the second support plate 504 and the spring 505 are omitted may be provided. Alternatively, the roller member 502 may be configured to be unable to rotate, and a configuration adopted in which a cylindrical member urged by the spring 505 is simply disposed at the contact portions T1 and T2.

In the modified examples described above, the ink ribbon 9 is peeled from the print tape 8 at the position of the guide wall 58. On the other hand, the print tape 8 is pressed by the isolation wall 53 so as to separate to the front, in the front-rear direction, from the ink ribbon 9. There, using the leading end 591, the presser wall 59 suppresses the print tape 8 from separating too far to the front, in the front-rear direction, from the ink ribbon 9. The leading end 591 is closer to the arm opening 341 than the leading end 581 of the guide wall 58, that is, is upstream of the leading end 581 on the conveyance path. In this way, the tape cassette 30 can more reliably perform the peeling of the ink ribbon 9 while securing the peeling distance necessary for the characters and the like transferred from the ink ribbon 9 to be fixed on the print tape 8, using the distance between the position of the print head to the leading end 591 in the conveyance path.

Further, the presser wall 59 has a rib shape, and can thus be integrally formed with the bottom wall 306. Further, the roller unit 50 is provided at the leading end 591, and thus, the frictional force in the conveyance of the print tape 8 is reduced. Thus, since the conveyance of the print tape 8 can be smoothly performed, the tape cassette 30 can more reliably perform the peeling of the ink ribbon 9 while securing the peeling distance.

Further, the roller unit 50 includes the spring 505, thus, using the urging force, the position of the print tape 8 on the conveyance path is maintained at the predetermined position. When a tension on the print tape 8 has become large, an elastic behavior can tolerate a temporary positional displacement of the print tape 8. Thus, the presser wall 59 can reduce the frictional force in the conveyance of the print tape 8. Thus, since the tape cassette 30 can smoothly convey the print tape 8, the tape cassette 30 can more reliably perform the peeling of the ink ribbon 9 while securing the peeling distance.

What is claimed is:

1. A tape cassette, comprising:

a cassette case including a bottom wall, and a side wall intersecting the bottom wall at a first side in a first direction, the cassette case having a recess recessed from a part of the side wall to a second side in the first direction, the second side in the first direction being opposite to the first side in the first direction, the part of the side wall including an opening, the recess passing through the cassette case in an up-down direction;

a tape roll housed inside the cassette case;

a print tape wound around the tape roll;

a ribbon roll housed inside the cassette case;

an ink ribbon wound around the ribbon roll;

a ribbon winding spool housed inside the cassette case;

an arm portion including a first wall and a second wall, the first wall being a part of the side wall, the second wall facing the first wall and extending upward from the bottom wall, the arm portion extending from a first side in a second direction to a second side in the second direction, the second direction being a direction intersecting the first direction and the up-down direction, the first side in the second direction being opposite to the second side in the second direction, the arm portion including a discharge port at an end, the end being positioned on the second side in the second direction with respect to the opening, the discharge port being configured to discharge the print tape and the ink ribbon conveyed between the first wall and the second wall, the recess being defined by the second wall and a peripheral wall at least;

a roller provided inside the cassette case further to the first side in the second direction than the arm portion, a part of an outer peripheral surface of the roller being exposed to the first side in the first direction of the cassette case, the roller being configured to guide the print tape discharged from the discharge port and in contact with the exposed part of the outer peripheral surface further to the first side in the second direction than the cassette case;

a first protrusion disposed, on a conveyance path of the print tape, at a position between the discharge port of the arm portion and the roller, the first protrusion including a first leading end protruding toward the first side in the first direction, the first leading end being positioned on a first virtual line or being positioned further to the first side in the first direction than the first virtual line, the first virtual line being a line connecting the exposed part of the outer peripheral surface of the roller with a connection portion between the second wall and the peripheral wall, the first protrusion being configured to guide the ink ribbon discharged along the conveyance path from the discharge port to a winding path, the winding path being a path branching from the conveyance path at the first leading end, toward the ribbon winding spool; and a second protrusion disposed at a position between the first protrusion and the roller in the second direction, the second protrusion including a second leading end protruding toward the first side in the first direction, the second leading end being positioned further to the first side in the first direction than a second virtual line, the second virtual line being a line connecting the exposed part of the outer peripheral surface of the roller with the first leading end of the first protrusion, the second protrusion being configured to guide the print tape discharged from the discharge port to the roller via the second leading end.

2. The tape cassette according to claim 1, wherein the tape cassette is configured to be mounted to and removed from a tape printer that includes a head holder including a print head, the recess is a portion where the head holder is inserted when the tape cassette is mounted to the tape printer, and the second leading end of the second protrusion is positioned further to the second side in the first direction than a third virtual line, the third virtual line being a line connecting the print head with the first leading end of the first protrusion when the head holder is inserted into the recess.

3. The tape cassette according to claim 1, wherein the second protrusion has a rib shape extending upward from the bottom wall and defining the winding path between the second protrusion and the first protrusion, and the second leading end is a roller member including a shaft in the up-down direction.

4. The tape cassette according to claim 1, wherein the second protrusion is an urging member urged to the first side in the first direction and pressing the print tape.

5. The tape cassette according to claim 1, wherein the tape cassette is configured to be mounted to and removed from a tape printer that includes a head holder including a print head, the recess is a portion where the head holder is inserted when the tape cassette is mounted to the tape printer, and the tape cassette further comprises:

a third protrusion positioned, in the conveyance path of the print tape, between a position of the print head when the head holder is inserted into the recess and the position of the first leading end of the first protrusion, the third protrusion including a third leading end protruding toward the second side in the first direction, the third protrusion being configured to regulate a movement of the print tape to the first side in the first direction by the third leading end coming into contact with the print tape conveyed between the discharge port and the second leading end of the second protrusion.

6. The tape cassette according to claim 5, wherein the third protrusion has a rib shape extending upward from the bottom wall, and the third leading end is a roller member including a shaft extending in the up-down direction.

7. The tape cassette according to claim 5, wherein the third protrusion is an urging member urged to the second side in the first direction and pressing the print tape.

8. The tape cassette according to claim 1, wherein the first protrusion has a rib shape extending upward from the bottom wall, and the first leading end is a roller member including a shaft extending in the up-down direction.

9. The tape cassette according to claim 1, wherein the first protrusion is an urging member urged to the first side in the first direction and pressing the ink ribbon and the print tape.

* * * * *